US008563841B1

(12) United States Patent
Good

(10) Patent No.: US 8,563,841 B1
(45) Date of Patent: Oct. 22, 2013

(54) SAFETY HOOP FOR DRUM

(75) Inventor: John J. Good, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 81 days.

(21) Appl. No.: 13/317,810

(22) Filed: Oct. 28, 2011

(51) Int. Cl.
*G10D 13/02* (2006.01)

(52) U.S. Cl.
USPC ..... 84/411 R

(58) Field of Classification Search
USPC ..... 84/411 R, 411 M, 421
See application file for complete search history.

(56) References Cited

U.S. PATENT DOCUMENTS 7,361,823 B2 * 4/2008 Rush ..... 84/411 R
7,786,363 B1 * 8/2010 Wei ..... 84/411 R

* cited by examiner

*Primary Examiner* — Kimberly Lockett
(74) *Attorney, Agent, or Firm* — William W. Haefliger

(57) ABSTRACT

Drum structure comprising, in combination a drum shell and a drum head, and a counter hoop to be supported by the shell proximate the head and having an edge shaped to resist or prevent drum stick damage, there being a drainage gap or opening providing access between the counter hoop and its side wall.

11 Claims, 3 Drawing Sheets

SAFETY HOOP FOR DRUM

BACKGROUND OF THE INVENTION

This invention relates generally to the construction of drums, where drum sticks are used to strike hoops on the drums. More particularly, it concerns the construction of such hoops to avoid problems arising in their use.

In the past, the configurations of drum hoops led to problems of drainage from under the hoops, and also to problems of interference with drums sticks, as during impact (rim shots). Such impact with hoop edges can cause severe damage to drum sticks. Also, water and other particles tended to accumulate under hoops. There is need for structural changes overcoming these and other problems and disadvantages.

SUMMARY OF THE INVENTION

It is a major object of the invention to provide solutions to the above problems. Basically, the invention is embodied in use of an improved hoop configuration, characterized by a) a hoop edge shaped to resist drum stick damage, and b) a drainage gap or opening providing access between the hoop and its side wall, for water and particulate egress.

As will be seen, the gap is typically provided to face the hoop outer side wall so as to prevent interference with a drum stick during impact against a blunted edge of the hoop. The gap is preferably concealed beneath a rolled or arcuate edge of the hoop.

Another object is to provide the rolled configuration extending toward the outer side of the hoop, for gap concealment.

Further objects include provision of a hoop flange spaced from and in offset relation to the blunted edge; and provision of sideward projections integral with the hoop, and spaced from said rolled edge, said projections defining openings for a drum tensioning rods.

An advantage to a top rolled hoop is that it leaves a smooth rounded surface for the drummer to strike the drumstick, on and without causing damage to the stick. The standard drum counter hoop has a straight edge or just a slight radius that causes severe damage to the stick as it is struck. Another advantage is strength, provided by rolling the top edge of the hoop, which increases strength and stability of the hoop. A further advantage is provision of a hoop edge that is extremely flat. With the rolled edge adding strength, the hoop will tend to stay in such flat condition, even under high tension.

Yet another object is to provide a drum shell having an edge rolled toward the outer side of the hoop.

These and other objects and advantages of the invention, as well as the details of an illustrative embodiment, will be more fully understood from the following specification and drawings, in which:

DRAWING DESCRIPTION

DETAILED DESCRIPTION

Figure 1:
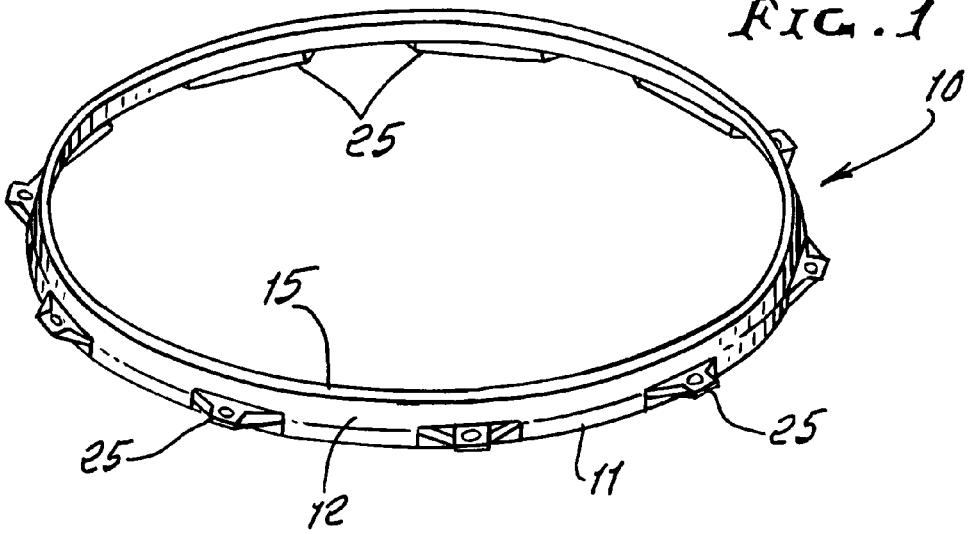
FIG. 1 is a perspective view of a drum hoop embodying the invention.
Figure 2:
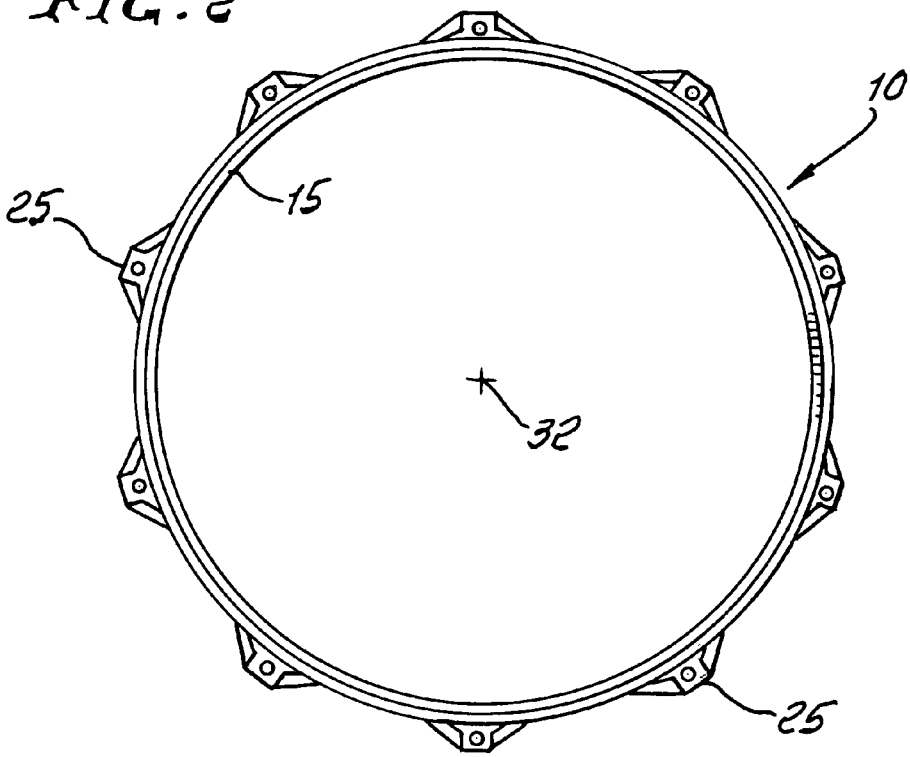
FIG. 2 is a plan view of the FIG. 1 hoop.
Figure 3:
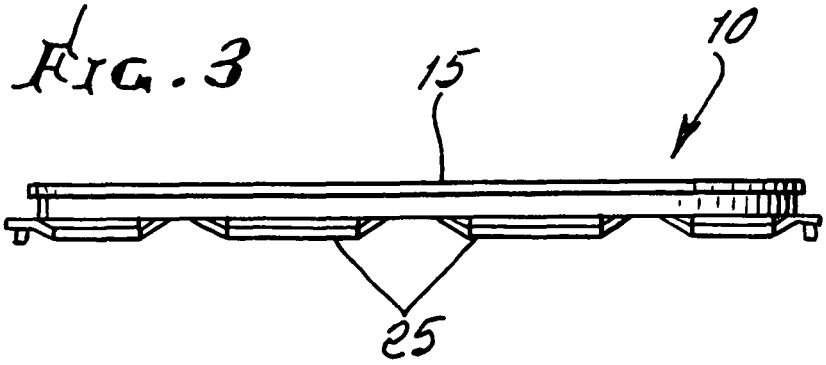
FIG. 3 is a view taken on lines 3-3 of FIG. 2.
Figure 4:
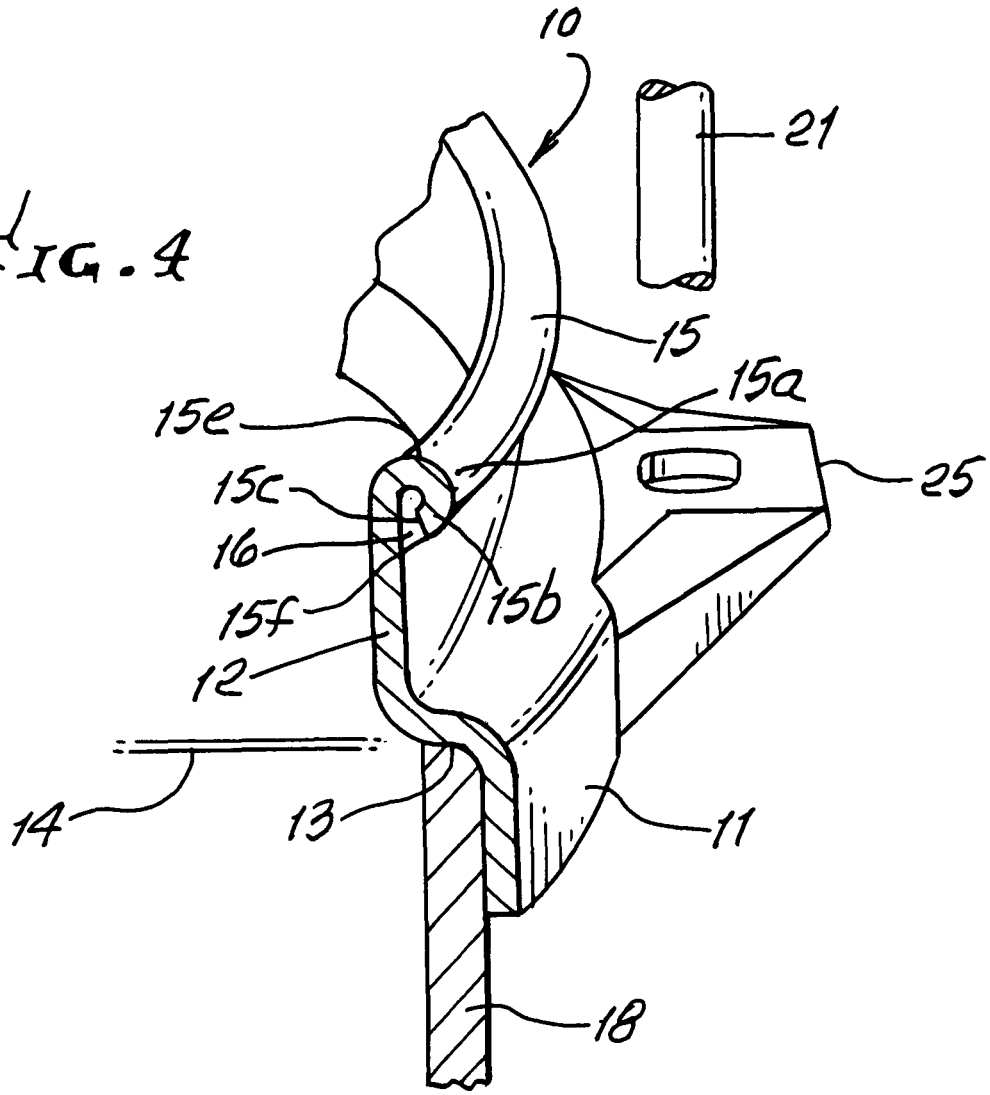
FIGS. 4 and 5 are enlarged fragmentary sections showing hoop construction.
Figure 5:
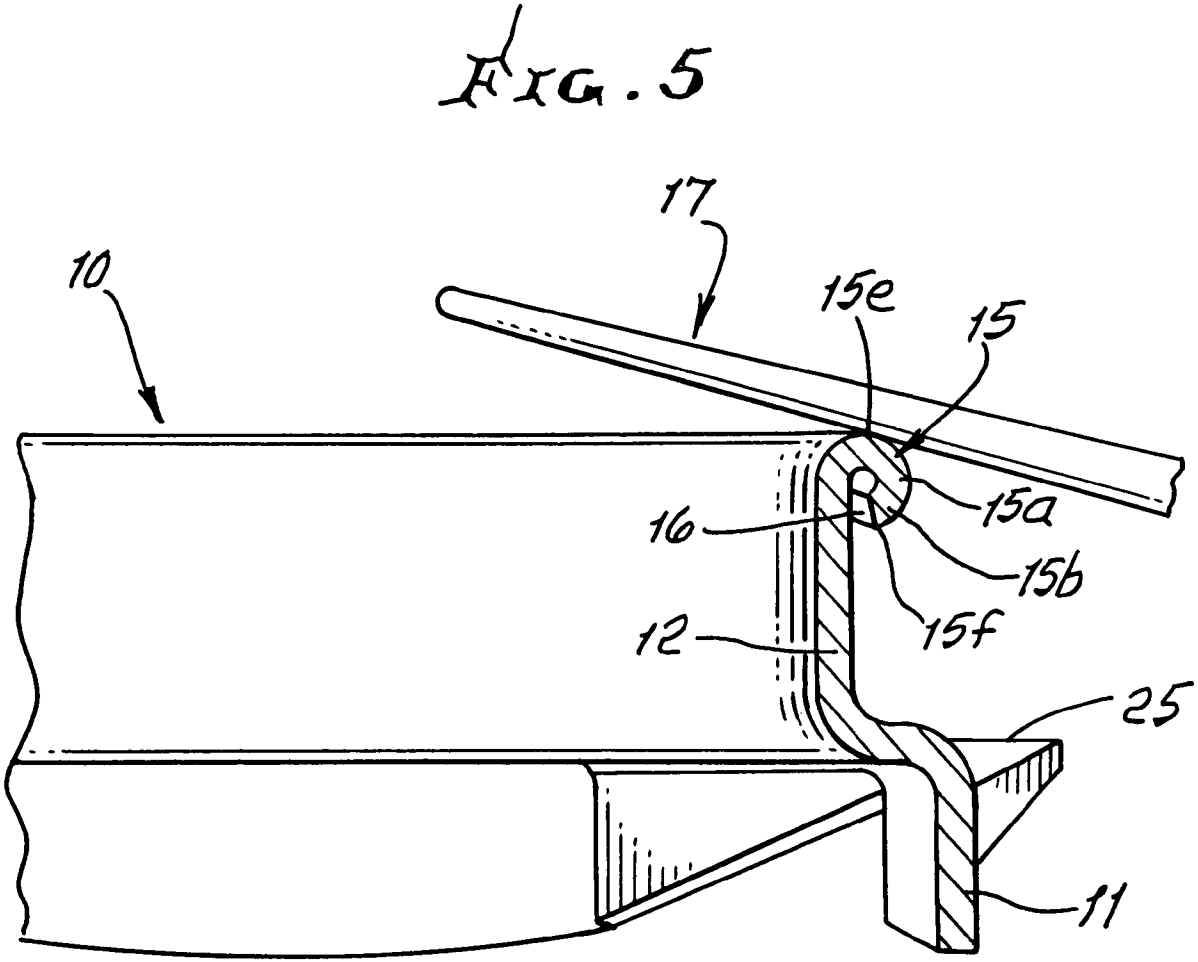

The drum hoop 10 has metallic construction, with walls 11 and 12 offset to receive a drum wall 18 therebetween, i.e.

beneath shoulder 13. Wall 12 has an upper edge 15 shaped to resist and prevent damage to a drum stick 17 shown impacting that edge, during play. Edge 15 is shown, preferably, as rolled toward the outer side of the hoop, and to extend downwardly at 15*a* and back inwardly at 15*b*. The edge terminal 15*c* faces toward wall 12, with a small gap or opening 16 located between 15*b* and w all 12, for water drainage.

Terminal 15*c* is in effect concealed from the arcuate upper surface 15*e* of the edge 15, which is much flatter than a projecting sharp edge, to resist damage to the drum stick. Location of gap 16, concealed and spaced below upper arcuate surface 15*c* prevents contact of the drum stick with the terminal 15*f*, and any sharp edge 15*f* thereof.

A sideward projection 25 from the hoop provides an opening for reception of a tensioning rod 21, in outwardly spaced relation from the gap 16.

A drum head is seen at 14, and a drum axis at 32.

I claim:

1. Drum structure comprising, in combination a) a drum shell and a drum head, and b) a counter hoop to be supported by the shell proximate the head and having an edge shaped to resist or prevent drum stick damage, c) there being a drainage gap or opening providing access between the counter hoop and its side wall, the gap or opening locating between the edge and said side wall, and d) the edge being arcuate and rolled toward the outer side of the hoop.

2. The combination of claim 1 wherein the edge is blunted.

3. The combination of claim 1 wherein the edge is arcuate.

4. The combination of claim 1 wherein the gap or opening is at a terminal defined by the rolled edge, the gap or opening extending circularly about the drum axis along with the rolled edge.

5. Drum structure comprising, in combination a) a drum shell and a drum head, and b) a counter hoop to be supported by the shell proximate the head and having an edge shaped to resist or prevent drum stick damage, c) there being a drainage gap or opening providing access between the counter hoop and its side wall, the gap or opening locating between the end and said side wall, and d) the edge being blunted, e) and wherein the hoop defines a circularly extending flange spaced from and in offset relation to the blunted edge.

6. The combination of claim 1 including a sideward projection integral with the hoop, and spaced from said rolled edge, said projection defining an opening for a drum tensioning rod.

7. The combination of claim 1 including said drum shell having an edge supporting said hoop at a shoulder defined by the hoop, the hoop having offset upright walls, the shoulder extending between said walls in approximate alignment with said hoop edge.

8. The combination of claim 7 wherein said edge and shoulder extend circularly about an axis defined by the shell.

9. The combination of claim 6 including multiple said side projections on and spaced about an axis formed by the hoop.

10. The combination of claim 1 including said drum shell having an edge supporting said hoop at a shoulder defined by the hoop.

11. The combination of claim 10 wherein the gap or opening is at a terminal defined by the rolled edge, the gap or opening extending circularly about the drum axis along with the rolled edge.

* * * * *